US012575611B2

(12) United States Patent
Lu et al.

(10) Patent No.: US 12,575,611 B2
(45) Date of Patent: Mar. 17, 2026

(54) ELECTRONIC VAPORIZATION DEVICE, POWER SUPPLY ASSEMBLY AND HOLDER THEREOF

(71) Applicant: Hainan Moore Brothers Technology Co., Ltd., Hainan (CN)

(72) Inventors: Fengwen Lu, Hainan (CN); Weidong Zhou, Hainan (CN); Deke Xie, Hainan (CN); Xiao'an Zhu, Hainan (CN)

(73) Assignee: Hainan Moore Brothers Technology Co., Ltd., Hainan (CN)

( * ) Notice: Subject to any disclaimer, the term of this patent is extended or adjusted under 35 U.S.C. 154(b) by 414 days.

(21) Appl. No.: 17/941,685

(22) Filed: Sep. 9, 2022

(65) Prior Publication Data

US 2023/0080303 A1 Mar. 16, 2023

(30) Foreign Application Priority Data

Sep. 14, 2021 (CN) ..... 202111076132.9

(51) Int. Cl.

| | |
|---|---|
| ***A24F 40/10*** | (2020.01) |
| ***A24F 40/40*** | (2020.01) |
| ***A24F 40/42*** | (2020.01) |
| ***A24F 40/485*** | (2020.01) |
| ***A24F 40/51*** | (2020.01) |

(52) U.S. Cl.

CPC ..... *A24F 40/485* (2020.01); *A24F 40/10* (2020.01); *A24F 40/42* (2020.01); *A24F 40/51* (2020.01)

(58) Field of Classification Search

CPC ..... A24F 40/10; A24F 40/40; A24F 40/42; A24F 40/44; A24F 40/48; A24F 40/485

See application file for complete search history.

(56) References Cited

U.S. PATENT DOCUMENTS

| | | | | |
|---|---|---|---|---|
| 2018/0168236 | A1 | 6/2018 | Qiu | |
| 2019/0364967 | A1 * | 12/2019 | Wu | A24F 40/485 |
| 2020/0236995 | A1 | 7/2020 | Zhou et al. | |
| 2023/0114975 | A1 * | 4/2023 | Matsuda | A24F 40/485 131/329 |

(Continued)

FOREIGN PATENT DOCUMENTS

| | | | | |
|---|---|---|---|---|
| CN | 204907937 U | | 12/2015 | |
| CN | 209643869 U | | 11/2019 | |
| CN | 110623301 A | * | 12/2019 | A24F 40/48 |

(Continued)

OTHER PUBLICATIONS

English Machine Translation of CN 111990696, obtained from PE2E Search (Clarivate Analytics) (Year: 2020).*

(Continued)

*Primary Examiner* — Philip Y Louie
*Assistant Examiner* — Charlotte Davison
(74) *Attorney, Agent, or Firm* — Leydig, Voit & Mayer, Ltd.

(57) ABSTRACT

A holder, applied to an electronic vaporization device, includes: a liquid storage groove and an air inlet column provided at an end of the holder, an air hole being provided in the air inlet column, the air hole being in fluid communication with the liquid storage groove. The air inlet column is provided with a drainage structure surrounding the air hole. The drainage structure drains liquid to the liquid storage groove.

17 Claims, 7 Drawing Sheets

(56) References Cited

U.S. PATENT DOCUMENTS

| | | | | |
|---|---|---|---|---|
| 2023/0200443 | A1* | 6/2023 | Liu | A24F 40/46 131/329 |

FOREIGN PATENT DOCUMENTS

| | | | | | |
|---|---|---|---|---|---|
| CN | 210445678 | U | | 5/2020 | |
| CN | 211558805 | U | | 9/2020 | |
| CN | 211746965 | U | | 10/2020 | |
| CN | 111990696 | A | * | 11/2020 | A24F 40/10 |
| CN | 211960896 | U | | 11/2020 | |
| CN | 112273728 | A | * | 1/2021 | A24F 40/40 |
| CN | 112273734 | A | | 1/2021 | |
| CN | 212279875 | U | | 1/2021 | |
| CN | 112493552 | A | | 3/2021 | |
| CN | 112890291 | A | | 6/2021 | |
| CN | 216459525 | U | | 5/2022 | |

OTHER PUBLICATIONS

English Machine Translation of CN 112273728, obtained from PE2E Search (Clarivate Analytics) (Year: 2021).*

English Machine Translation of CN 110623301, obtained from PE2E Search (Clarivate Analytics) (Year: 2019).*

Patent Cooperation Treaty, International Search Report, International Application No. PCT/CN2021/118278 (Jun. 13, 2022).

Patent Cooperation Treaty, Written Opinion of the International Searching Authority, International Application No. PCT/CN2021/118278 (Jun. 13, 2022).

Chinese Patent Office, Office Action in Chinese Patent Application No. 202111076132.9 (Jul. 18, 2024).

Chinese Patent Office, Office Action in Chinese Patent Application No. 202111076132.9 (Sep. 26, 2024).

* cited by examiner

ELECTRONIC VAPORIZATION DEVICE, POWER SUPPLY ASSEMBLY AND HOLDER THEREOF

CROSS-REFERENCE TO PRIOR APPLICATION

Priority is claimed to Chinese Patent Application No. 202111076132.9, filed on Sep. 14, 2021, the entire disclosure of which is hereby incorporated by reference herein.

FIELD

The present invention relates to the field of vaporization, and in particular, to an electronic vaporization device, a power supply assembly and a holder thereof.

BACKGROUND

An electronic vaporization device generally includes a vaporizer and a power supply assembly, where the vaporizer is configured to heat and vaporize liquid, and the power supply assembly is configured to control the operation of the vaporizer.

Currently, common power supply assemblies on the market generally include an electric core, an airflow sensor and a control plate. When the airflow sensor detects an airflow change in the electronic vaporization device, the control plate controls the electric core to supply power to the vaporizer.

However, during the use of the electronic vaporization device, liquid or aerosol condensate in the vaporizer may leak into the power supply assembly, blocking an air inlet channel of the airflow sensor. As a result, the airflow sensor fails to detect an airflow change in the electronic vaporization device, causing the electronic vaporization device to fail to be normally started.

SUMMARY

In an embodiment, the present invention provides a holder, applied to an electronic vaporization device, comprising: a liquid storage groove and an air inlet column provided at an end of the holder, an air hole being provided in the air inlet column, the air hole being in fluid communication with the liquid storage groove, wherein the air inlet column is provided with a drainage structure surrounding the air hole, and wherein the drainage structure is configured to drain liquid to the liquid storage groove.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
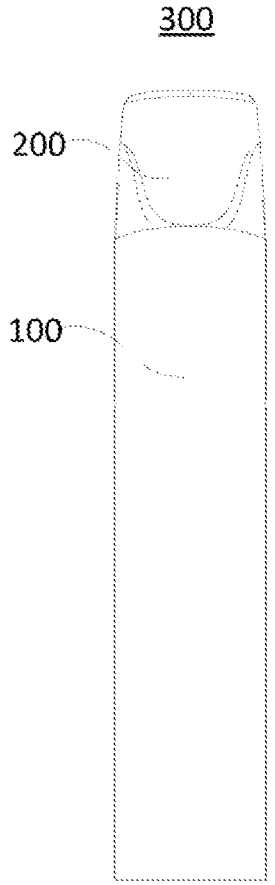
FIG. 1 is a schematic structural diagram of an embodiment of an electronic vaporization device according to this application.

In an embodiment, the present invention provides an electronic vaporization device, a power supply assembly and a holder thereof to resolve a problem that an airflow channel is prone to be blocked.

In an embodiment, the present invention provides a holder. A liquid storage groove and an air inlet column are provided at an end of the holder, an air hole is provided in the air inlet column, the air hole is in fluid communication with the liquid storage groove, a drainage structure is arranged at an end of the air inlet column that is away from a bottom wall of the liquid storage groove, the drainage structure surrounds the air hole, and the drainage structure is configured to drain liquid to the liquid storage groove.

In some embodiments, the drainage structure is a drainage slope surrounding the air hole. In some embodiments, an angle between the drainage slope and an axis of the air hole is greater than or equal to 30 degrees and less than or equal to 60 degrees.

In some embodiments, the air hole is provided on a first end surface of the air inlet column that is away from a bottom wall of the liquid storage groove, and the first end surface has a width greater than or equal to 0.1 mm and less than or equal to 0.3 mm in a radial direction of the air hole.

In some embodiments, an isolation groove is formed between the air inlet column and a side wall of the liquid storage groove, and the isolation groove at least partially surrounds the air inlet column.

In some embodiments, the isolation groove is in communication with the liquid storage groove.

In some embodiments, a bottom wall of the isolation groove is a guide inclined wall configured to guide the liquid to the liquid storage groove.

In some embodiments, an isolation wall is further arranged at an end of the holder, the isolation wall at least partially surrounds the air inlet column, the isolation groove is provided between the isolation wall and the air inlet column, an opening is formed on the isolation wall, and the isolation groove is in communication with the liquid storage groove through the opening.

In some embodiments, the air inlet column is at least partially embedded in the side wall of the liquid storage groove, the isolation wall includes a ring stop portion, the ring stop portion extends from the side wall of the liquid storage groove to the liquid storage groove, the ring stop portion surrounds the air inlet column, and the opening is formed in the ring stop portion.

In some embodiments, at least one air inlet is provided in the side wall of the liquid storage groove, where at least one of the air inlets is provided at a position at which the air inlet column is embedded in the side wall of the liquid storage groove.

In some embodiments, a first end surface of the air inlet column is higher than a second end surface of the isolation wall, the first end surface is an end surface of the air inlet column that is away from a bottom wall of the liquid storage groove, and the second end surface is an end surface of the isolation wall that is away from the bottom wall of the liquid storage groove.

In some embodiments, a height difference between the first end surface and the second end surface is within a range of 0.2 mm to 0.4 mm.

In some embodiments, the first end surface is lower than a third end surface of the side wall of the liquid storage groove, and the third end surface is an end surface of the side wall of the liquid storage groove that is away from the bottom wall of the liquid storage groove.

In some embodiments, a height difference between the third end surface and the first end surface is within a range of 0.06 mm to 0.1 mm.

In some embodiments, the holder includes a back plate and a connecting base that is arranged at an end of the back plate, the liquid storage groove and the air inlet column are provided at an end of the connecting base that is away from the back plate, a mounting cavity is provided in the back plate, and the air hole is in communication with the mounting cavity.

In order to resolve the technical problem, another technical solution adopted in this application is to provide a power supply assembly. The power supply assembly includes an airflow sensor and a holder as described above, and the airflow sensor is arranged on the holder and is in fluid communication with an air hole.

In order to resolve the technical problem, still another technical solution adopted in this application is to provide an electronic vaporization device. The electronic vaporization device includes a vaporizer and a power supply assembly as described above, and the power supply assembly is connected to the vaporizer and supplies power to the vaporizer.

The beneficial effects of this application are: different from a situation in the related art, this application discloses an aerosol generation device. The liquid storage groove and the air inlet column are provided at an end of the holder. The air hole is provided in the air inlet column, the air hole is in fluid communication with the liquid storage groove, and the drainage structure is arranged at an end of the air inlet column that is away from the bottom wall of the liquid storage groove. The drainage structure surrounds the air hole, and the drainage structure is configured to drain the liquid to the liquid storage groove, which not only helps reduce the accumulation amount of the liquid around the air inlet column, but also helps guide the liquid from an end portion of the air inlet column to the liquid storage groove, thereby effectively reducing the risk of blocking the air hole by the liquid.

The technical solutions in the embodiments of this application are clearly and completely described in the following with reference to the accompanying drawings in the embodiments of this application. Apparently, the described embodiments are merely some rather than all of the embodiments of this application. All other embodiments obtained by a person skilled in the art based on the embodiments of this application without creative efforts shall fall within the protection scope of this application.

Figure 2:
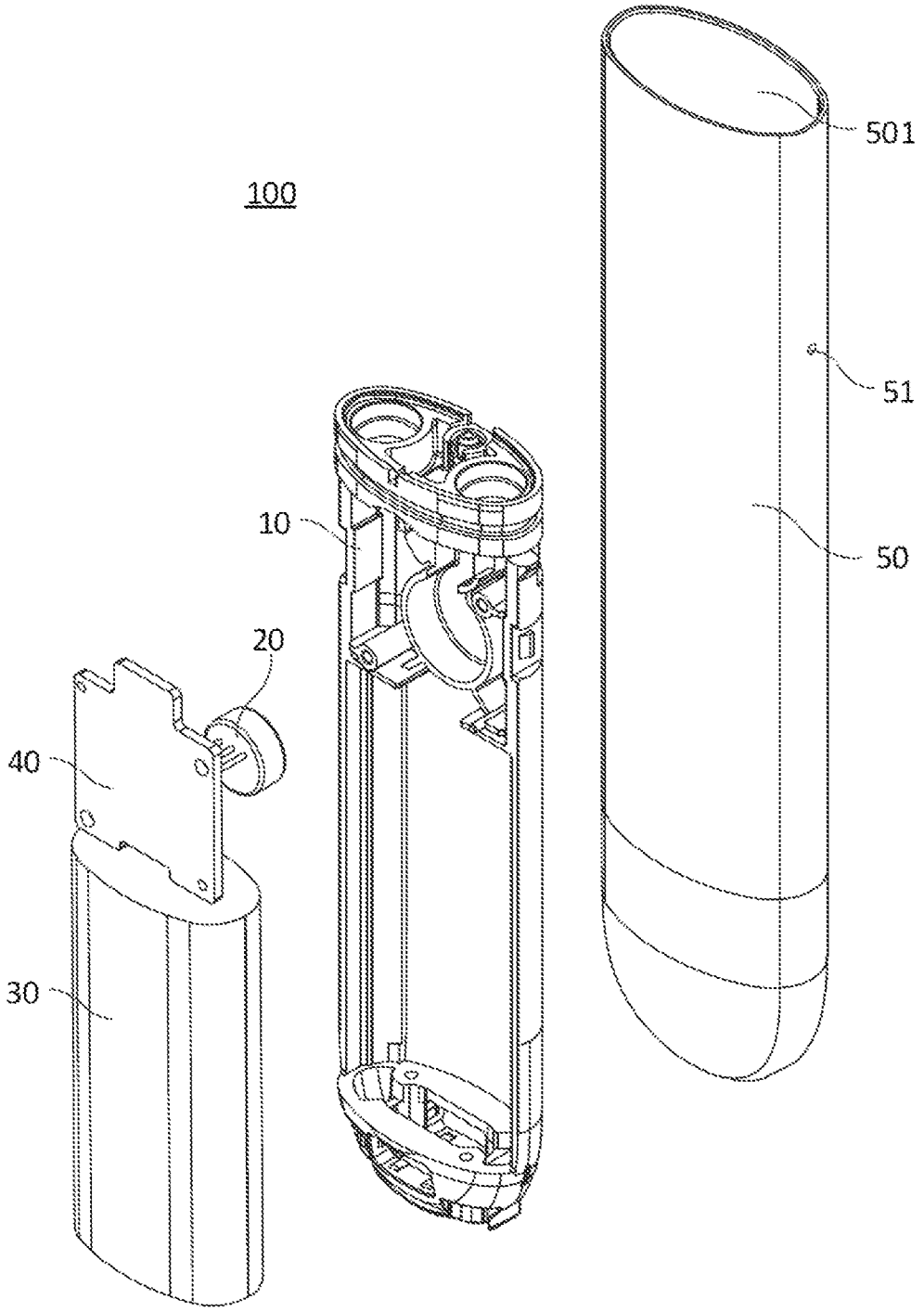
FIG. 2 is a schematic exploded view of a power supply assembly in the electronic vaporization device shown in FIG. 1.
Figure 3:
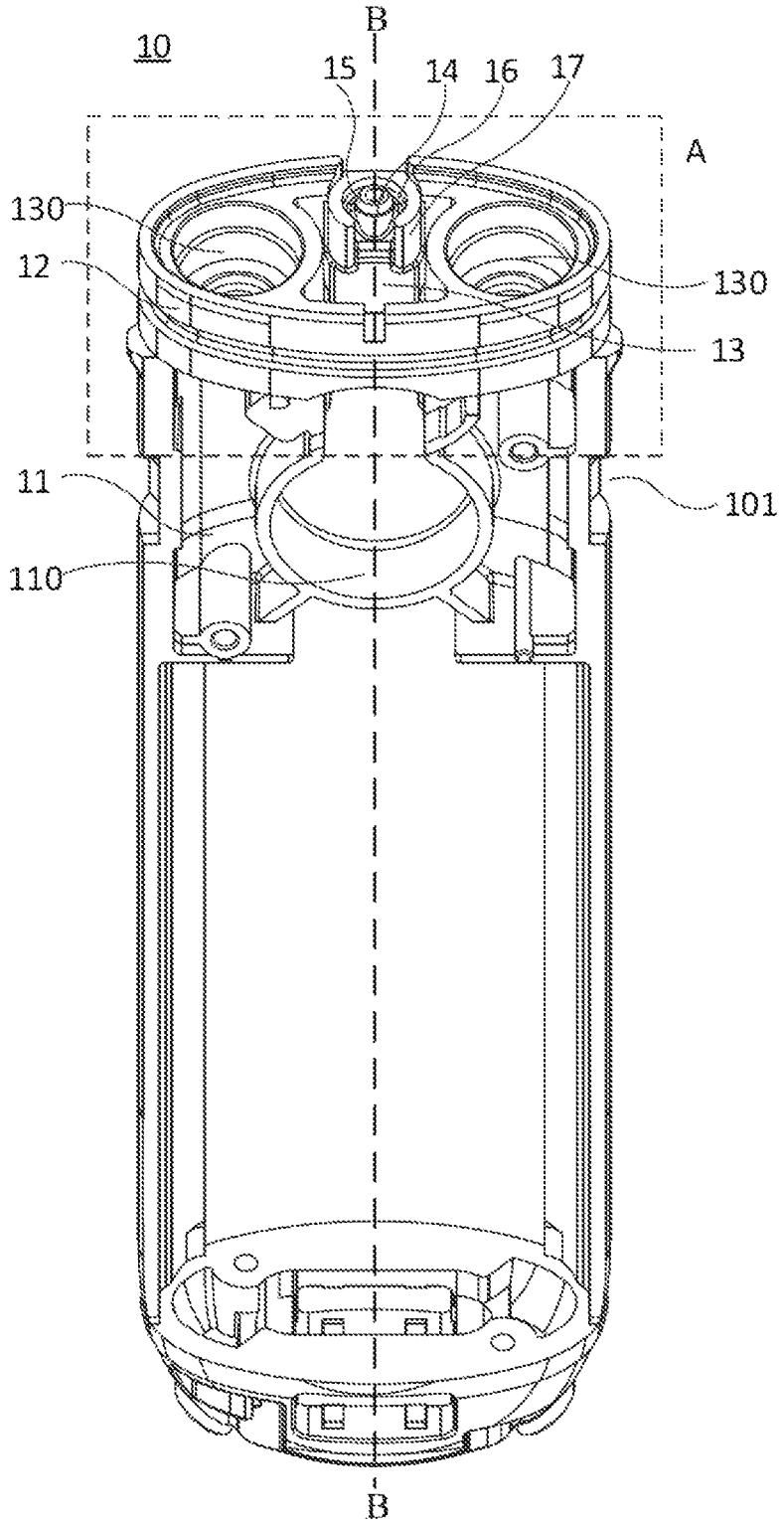
FIG. 3 is a schematic structural diagram of a holder in the electronic vaporization device shown in FIG. 2.
Figure 4:
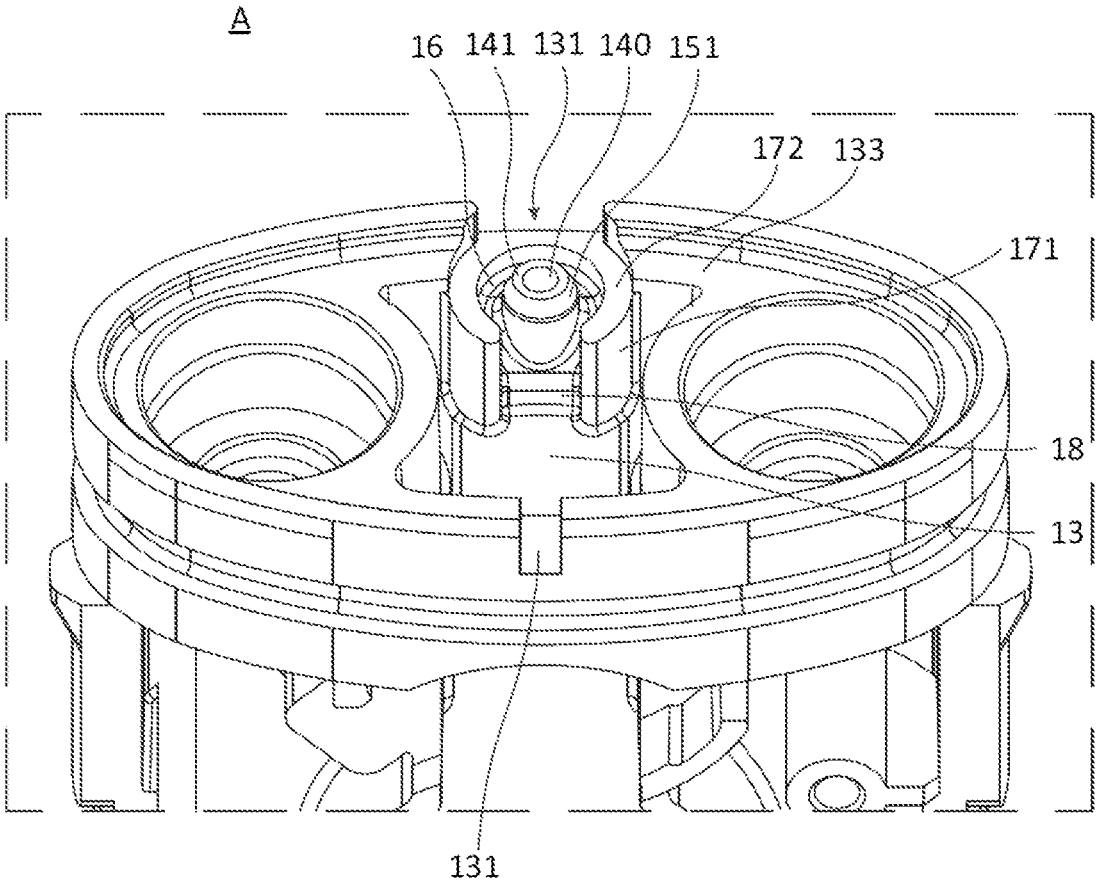
FIG. 4 is an enlarged schematic structural diagram of a region A in the holder shown in FIG. 3.
Figure 5:
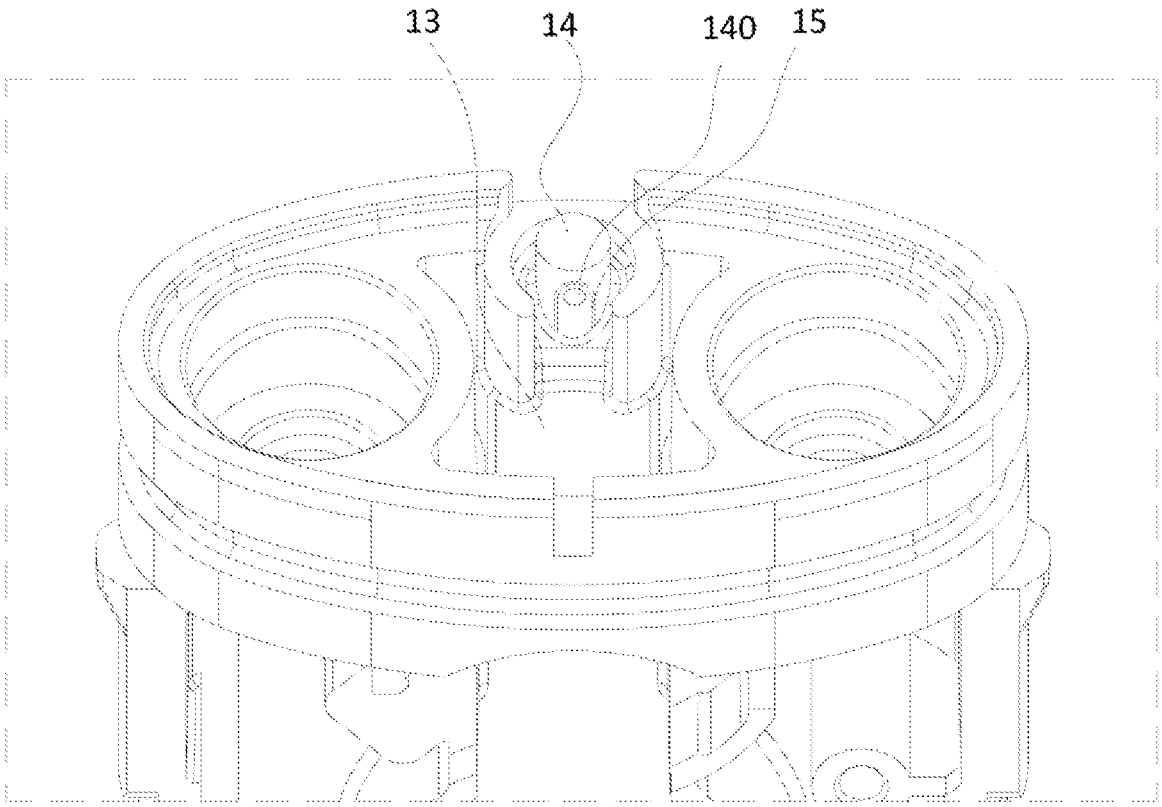
FIG. 5 is an enlarged schematic structural diagram of another embodiment of an air hole of the region A in the holder shown in FIG. 3.
Figure 6:
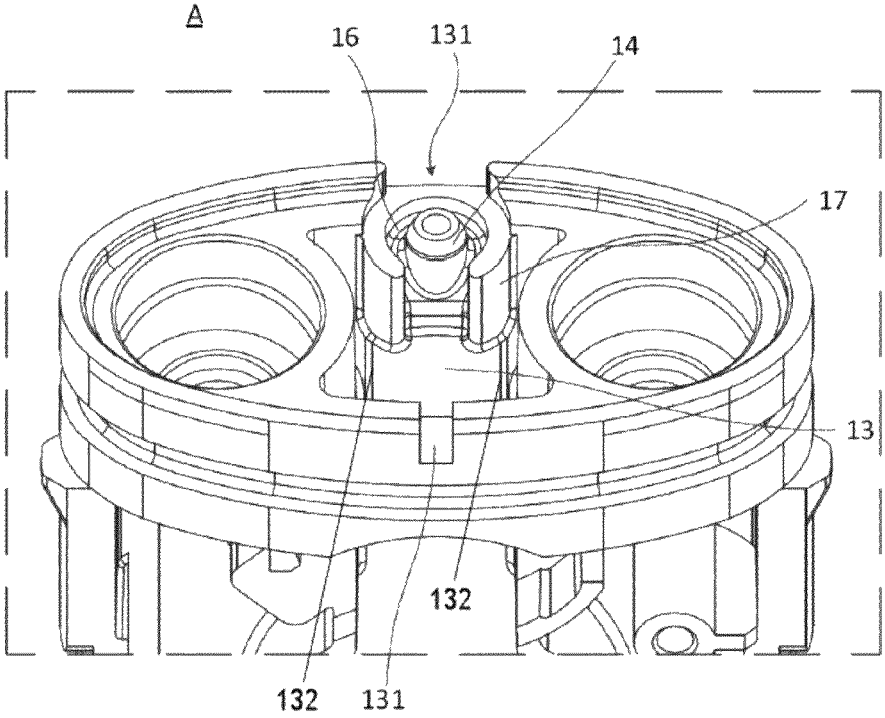
FIG. 6 is an enlarged schematic structural diagram of the region A in the holder shown in FIG. 3.

This application provides an electronic vaporization device 300. Referring to FIG. 1 to FIG. 6, FIG. 1 is a schematic structural diagram of an electronic vaporization device according to an embodiment of this application; FIG. 2 is a schematic exploded view of a power supply assembly in the electronic vaporization device shown in FIG. 1; FIG. 3 is a schematic structural diagram of a holder in the electronic vaporization device shown in FIG. 2; FIG. 4 is an enlarged schematic structural diagram of a region A in the holder shown in FIG. 3; FIG. 5 is an enlarged schematic structural diagram of another embodiment of an air hole of the region A in the holder shown in FIG. 3; and FIG. 6 is an enlarged schematic structural diagram of the region A in the holder shown in FIG. 3.

The electronic vaporization device 300 is configured to vaporize an aerosol generation substrate when the electronic vaporization device 300 is electrified, to generate an aerosol, which can be applied in different fields, such as drug vaporization, agricultural spraying, hair spray vaporization, and oil liquid vaporization. The aerosol generation substrate may be liquid medicine or a nutrient solution, or the like.

As shown in FIG. 1, the electronic vaporization device 300 includes a vaporizer 200 and a power supply assembly 100 that are connected to each other. The vaporizer 200 is configured to store the aerosol generation substrate and vaporize the aerosol generation substrate to generate the aerosol. The power supply assembly 100 is configured to supply power to the vaporizer 200 so that the vaporizer 200 can vaporize the aerosol generation substrate stored therein.

In this application, the terms "include", "have", and any variant thereof are intended to cover a non-exclusive inclusion. For example, a process, method, system, product, or device that includes a series of steps or units is not limited to the listed steps or units, but further optionally includes a step or unit that is not listed, or further optionally includes another step or unit that is intrinsic to the process, method, product, or device.

The vaporizer 200 may include a liquid storage tank, a vaporization base, a vaporization core, and a base. The liquid storage tank is configured to store an aerosol generation substrate, the vaporization base is embedded in the liquid storage tank, and the base is sealed at an opening end of the liquid storage tank and is connected to the vaporization base to form a vaporization cavity. The vaporization core is arranged in the vaporization base and can obtain the aerosol generation substrate in the liquid storage tank. When being electrified, the vaporization core vaporizes the aerosol generation substrate to generate an aerosol to be used by the user.

Referring to FIG. 2, the power supply assembly 100 includes a holder 10, an airflow sensor 20, an electric core 30, a control plate 40, a shell 50 and an electrode. The airflow sensor 20 and the electric core 30 are both mounted on the holder 10. The control plate 40 is connected to the holder 10 and blocks the airflow sensor 20 from a side. The electrode is arranged on the holder 10 and is connected to the control plate 40, and the electrode is configured to be externally connected to the vaporizer 200, to supply power to the vaporizer 200. The shell 50 defines accommodating cavity 501; the airflow sensor 20, the electric core 30 and the control plate 40 are embedded in the accommodating cavity 501 of the shell 50 together with the holder 10. The shell 50 is further provided with an opening, and the vaporizer 200 is arranged at the opening of the shell 50 to be electrically connected to the power supply assembly 100.

In an implementation, magnetic members are arranged on both the power supply assembly 100 and the vaporizer 200, so that the power supply assembly 100 may be detachably connected to the vaporizer 200 through a magnetic force.

In another implementation, clamping structures are arranged on both the power supply assembly 100 and the vaporizer 200. For example, a groove is provided in the power supply assembly 100, and a protrusion is arranged on the vaporizer 200; or the protrusion is arranged on the power supply assembly 100, and the groove is provided in the vaporizer 200. The power supply assembly 100 is detachably connected to the vaporizer 200 through the clamping structures.

The airflow sensor 20 and the electric core 30 are both electrically connected to the control plate 40. When detecting an airflow or air pressure change, the airflow sensor 20 sends a trigger signal, and the control plate 40 accordingly controls the electric core 30 to supply power to the vaporizer 200. The airflow sensor 20 may be a device such as a microphone that detects an air pressure change or a flow velocity change.

As shown in FIG. 3, a buckle structure 101 is further arranged on a side wall of the holder 10. The buckle structure 101 is configured to be fixedly connected to the shell 50, so as to avoid the holder 10 from being loosened from or falling off from the shell 50, and help improve the stability of power supplied from the power supply assembly 100 to the vaporizer 200, thereby preventing electronic components such as the electric core 30, the control plate 40, and the airflow sensor 20 accommodated in the shell 50 from shaking during use, thus avoiding accidents such as electrical disconnection.

The buckle structure 101 may be a groove or a protruding post, which is detachably connected to an inner wall of the shell 50.

In other embodiments, the power supply assembly 100 may not include the shell 50, and the holder 10 achieves the functions of the shell 50. Alternatively, in the electronic vaporization device 300, the vaporizer 200 and the power supply assembly 100 are non-detachable from each other, and the holder 10 may be served as a shell of both the vaporizer 200 and the power supply assembly 100.

"Embodiment" mentioned in the specification means that particular features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

Referring to FIG. 2 to FIG. 5, the holder 10 includes a back plate 11 and a connecting base 12 that is arranged at an end of the back plate 11. A liquid storage groove 13 and an air inlet column 14 are provided at an end of the connecting base 12 that faces away from the back plate 11, and a mounting cavity 110 is provided in the back plate 11. The mounting cavity 110 is configured to mount the airflow sensor 20. The air inlet column 14 includes an air hole 140, and the air hole 140 is in communication with the liquid storage groove 13 and the mounting cavity 110. After the airflow sensor 20 senses an airflow change in the liquid storage groove 13 through the air hole 140, the power supply assembly 100 supplies power to the vaporizer 200.

Accommodating grooves 130 are respectively provided at both sides of the liquid storage groove 13. The accommodating groove 130 is configured to mount the electrode, and the accommodating groove 130 may further be configured to mount a magnetic member. For example, the magnetic member is arranged in the accommodating groove 130 and surrounds the electrode. The magnetic member may be a permanent magnet or a ferromagnet. The magnetic member is configured to be magnetically connected to the vaporizer 200, and the electrode is configured to be electrically connected to the vaporizer 200.

Optionally, the airflow sensor 20 is accommodated in the mounting cavity 110, and a liquid absorbing member may further be arranged in the mounting cavity 110. The liquid absorbing member may be liquid absorbing cotton, liquid absorbing paper or desiccant. The liquid absorbing member is configured to absorb liquid leaking into the mounting cavity 110 to avoid damage to the airflow sensor 20 due to liquid leakage, thereby reducing the risk of failure of the airflow sensor 20 and increasing the service life of the airflow sensor 20. In this embodiment, the electric core 30 and the control plate 40 are also mounted on the back plate 11. An air suction hole 51 is provided in the shell 50. The outside air flows through the liquid storage groove 13 via the air suction hole 51 and flows to the vaporizer 200, and then it can be detected, through the air hole 140, whether the user sucks the vaporizer 200.

In other implementations, the holder 10 may further only include the connecting base 12, and the airflow sensor 20, the electric core 30, and the control plate 40 may also be arranged on other structural members. Alternatively, the holder 10 may be in other shapes. For example, the holder 10 is generally prismatic or cylindrical, which is not specifically limited in this application.

In this embodiment, as shown in FIG. 2 and FIG. 3, a liquid storage groove 13 and an air inlet column 14 are provided at an end of the holder 10. An air hole 140 is provided in the air inlet column 14. The air hole 140 is in fluid communication with the liquid storage groove 13, and the air inlet column 14 is provided with a drainage structure 15 surrounding the air hole 140. The drainage structure 15 is configured to drain the liquid to the liquid storage groove 13. It should be noted that the fluid communication represents that the air flow may flow between a region of the liquid storage groove 13 and a region of the air hole 140.

As shown in FIG. 4, in this embodiment, the air hole 140 is provided at an end of the air inlet column 14 that is away from a bottom wall of the liquid storage groove 13. The drainage structure 15 surrounds the air hole 140 to increase a height of the air hole 140 and prevent too much accumulated fluid in the liquid storage groove 13 from flowing into the air hole 140.

Optionally, referring to FIG. 5, the air hole 140 may further be provided in a side wall of the air inlet column 14, and the drainage structure 15 surrounds the air hole 140, to prevent condensate on the vaporizer 200 from directly dripping into the air inlet hole 140.

In an implementation, the air inlet hole in the vaporizer 200 approximately faces a center of the liquid storage groove 13. A position of the air inlet column 14 is misaligned with a position of the air inlet hole of the vaporizer 200 to prevent leaked liquid from dripping into the air hole 140.

Optionally, the air inlet column 14 may be provided in the liquid storage groove 13, that is, the air inlet column 14 is connected to the bottom wall of the liquid storage groove 13, and the air inlet column 14 is spaced apart from the side wall 132 of the liquid storage groove 13. Alternatively, the air inlet column 14 may further be partially or completely embedded in the side wall 132 of the liquid storage groove 13, so that the air inlet column 14 may be relatively far away from the air inlet hole of the vaporizer 200, which can significantly reduce the risk of the leaked liquid dripping into the air hole 140.

The air inlet hole in the vaporizer 200 directly faces the liquid storage groove 13, and the liquid storage groove 13 is mainly configured to store the liquid leaked from the air inlet hole, so as to prevent the leaked liquid from flowing to devices such as the electric core 30 and the control plate 40.

The external air flow flows through the liquid storage groove 13 and runs to an air inlet hole of the vaporizer 200. Liquid such as moisture and leaked liquid carried by the air flow may condense on an end surface of the air inlet column 14, and even liquid on an end surface of the holder 10 is guided into the air inlet column 14, causing a higher risk of blocking the air hole 140.

As shown in FIG. 4, the drainage structure 15 may be annular, and then may be arranged 360 degrees around the air hole 140. Alternatively, the drainage structure 15 may partially surround the air hole 140, for example, surrounding half of the air hole 140, which is not specifically limited in this application.

Optionally, the drainage structure 15 may be a drainage slope 151 such as an chamfer or a fillet. The drainage structure 15 may further be a drainage groove or a drainage hole, which may reduce an area of a first end surface 141 of an end of the air inlet column 14 that is away from the bottom wall of the liquid storage groove 13, which reduces the amount of the liquid accumulated on the first end surface 141 and also helps introduce the liquid accumulated on the first end surface 141 into the liquid storage groove 13. In this way, the amount of the liquid accumulated on the first end surface 141 is further reduced, thereby effectively reducing the risk of the liquid entering the air hole 140.

Further, when the drainage structure 15 is the drainage slope 151, an angle between the drainage slope 151 and an axis of the air hole 140 is greater than or equal to 30 degrees and less than or equal to 60 degrees, so as to increase the drainage efficiency of the drainage slope 151. Optionally, the angle between the drainage slope 151 and the axis of the air hole 140 may be 30 degrees, 35 degrees, 40 degrees, 45 degrees, 50 degrees, 55 degrees or 60 degrees.

In this application, the terms "first", "second" and "third" are used merely for the purpose of description, and shall not be construed as indicating or implying relative importance or implying a quantity of indicated technical features. Therefore, features defining "first" "second" and "third" can explicitly or implicitly include at least one of the features.

As shown in FIG. 5, the air hole 140 is provided in the side wall of the air inlet column 14, and the drainage structure 15 may further be a drainage groove and surrounds the air hole 140 to guide the liquid, which flows to the air hole 140, to the liquid storage groove 13.

Specifically, the liquid storage groove 13 is configured to store the liquid leaked into the power supply assembly 100. The air hole 140 in the air inlet column 14 is in communication with the airflow sensor 20. When a suction operation is performed on the vaporizer 200, the airflow sensor 20 senses an airflow change in the electronic vaporization device through the air hole 140, feeds back a signal to the control plate 40, and then controls the electric core 30 to supply power to the vaporizer 200. The drainage structure 15 is configured to guide the liquid accumulated at an end of the air inlet column 14 that is away from the bottom wall of the liquid storage groove 13 to the liquid storage groove 13, to prevent an excess amount of liquid from being accumulated on the end surface of the air inlet column 14 that is away from the bottom wall of the liquid storage groove 13. The risk of blocking the air hole 140 by the liquid can be significantly reduced, to prevent the electronic vaporization device 300 from failing to be normally started because the airflow sensor 20 fails to sense the airflow change.

In this embodiment, the air hole 140 is provided at an end of the air inlet column 14 that is away from a bottom wall of the liquid storage groove 13, and the drainage structure 15 is a drainage slope 151 surrounding the air hole 140. For example, an end of the air inlet column 14 that is away from the bottom wall of the liquid storage groove 13 may be a chamfer or fillet to form the drainage slope 151.

It can be understood that when an end of the air inlet column 14 that is away from the bottom wall of the liquid storage groove 13 is designed to be a chamfer, an end of the air inlet column 14 that is away from the bottom wall of the liquid storage groove 13 is divided into the first end surface 141 and the drainage slope 151. Compared with a design without the chamfer, the drainage slope 151 may reduce a platform area of an end surface of the air inlet column 14 that is away from the bottom wall of the liquid storage groove 13, thereby reducing the amount of liquid accumulated on the air inlet column 14. In addition, it is also easier for the liquid to flow into the liquid storage groove 13 through the drainage slope 151, thereby reducing the risk of the liquid flowing into the air hole 140.

Further, a width of the first end surface 141 of the air inlet column 14 that is away from the bottom wall of the liquid storage groove 13 is greater than or equal to 0.1 mm and less than or equal to 0.3 mm in a radial direction of the air hole 140, so that the air inlet column 14 may have a specific strength, and the amount of liquid accumulated on the first end surface 141 can be reduced; moreover, the liquid on the air inlet column 14 can easily flow into the liquid storage groove 13 through the drainage slope 151.

Optionally, a width of the first end surface 141 is 0.1 mm, 0.2 mm or 0.3 mm in the radial direction of the air hole 140.

In other implementations, the drainage structure 15 may alternatively be a plurality of guiding grooves surrounding the air hole 140. The guiding groove has an end arranged on the end surface of the air inlet column 14 that is away from the liquid storage groove 13, and another end extending toward the liquid storage groove 13 for guiding the liquid on the air inlet column 14 into the liquid storage groove 13.

In description of this application, "more" means at least two, such as two and three unless it is specifically defined otherwise.

Further, an isolation groove 16 is formed between the air inlet column 14 and the side wall of the liquid storage groove 13, and the isolation groove 16 at least partially surrounds the air inlet column 14. By providing the isolation groove 16 between the air inlet column 14 and the side wall of the liquid storage groove 13, the isolation groove 16 can block the liquid on the side wall of the liquid storage groove 13 from flowing into a region of the air inlet column 14, thereby reducing sources of liquid around the air inlet hole 140. When the isolation groove 16 surrounds the air inlet column 14 completely, the isolation groove 16 may further be configured to accommodate the liquid flowing into the side wall of the air inlet column 14 and the liquid storage groove 13, and is equivalent to a secondary liquid storage groove.

Optionally, the isolation groove 16 surrounds the air inlet column 14, the isolation groove 16 is isolated from the liquid storage groove 13, and the isolation groove 16 may store the guided on the air inlet column 14. The side wall of the isolation groove 16 that is close to the liquid storage groove 13 is lower than the side walls of the air inlet column 14 and the liquid storage groove 13. When the liquid accommodated in the isolation groove 16 is full, the liquid in the isolation groove 16 may overflow the isolation groove 16 and flow into the liquid storage groove 13.

In an embodiment, the isolation groove 16 is further in communication with the liquid storage groove 13, and the isolation groove 16 may guide the accommodated liquid into the liquid storage groove 13, thereby preventing the liquid stored in the isolation groove 16 from overflowing and entering the air hole 140.

Further, a bottom wall of the isolation groove 16 may be a plane or a guide inclined wall. When the bottom wall of the isolation groove 16 is a guide inclined wall, a lowest part of the guide inclined wall is close to the liquid storage groove 13. The liquid in the isolation groove 16 is guided to the liquid storage groove 13 along the guide inclined wall, so that the liquid guiding effect of the isolation groove 16 is improved. Further, an isolation wall 17 is further arranged at an end of the holder 10. The isolation wall 17 surrounds the air inlet column 14, and the isolation groove 16 is provided between the isolation wall 17 and the air inlet column 14. An opening 18 is formed in the isolation wall 17, and the isolation groove 16 is in communication with the liquid storage groove 13 through the opening 18.

The isolation wall 17 makes it more difficult for the liquid on the end surface of the holder 10 to flow to the air hole 140, and the isolation wall 17 may further block moisture in the liquid storage groove 13 from flowing to the air hole 140, which helps reduce the risk of blocking the air hole 140.

Optionally, the isolation wall 17 surrounds the air inlet column 14. When the air inlet column 14 is spaced apart from the side wall of the liquid storage groove 13, the isolation wall 17 may also be spaced apart from the side wall of the liquid storage groove 13. The isolation wall 17 may further be integrally formed with the side wall of the isolation groove 16.

Optionally, the opening 18 is a through hole provided in the isolation wall 17 at a side close to the liquid storage groove 13, and the liquid in the isolation groove 16 flows into the liquid storage groove 13 through the through hole.

In this embodiment, the opening 18 is a notch that extends from the end surface of the isolation wall 17 that is away from the bottom wall of the liquid storage groove 13 to the bottom wall of the liquid storage groove 13. The opening 18 is provided as a notch, to reduce the processing difficulty and achieve a better flow guiding effect.

The air inlet column 14 is at least partially embedded in the side wall of the liquid storage groove 13. The isolation wall 17 is formed at the side wall of the liquid storage groove 13. The isolation wall 17 includes a ring stop portion 171 that extends from the side wall of the liquid storage groove 13 into the liquid storage groove 13, and an opening 18 is formed in the ring stop portion 171.

Specifically, the air inlet column 14 is partially embedded in the side wall of the liquid storage groove 13, and the isolation wall 17 is in an annular shape with an opening 18. A portion of the isolation wall 17 is embedded in the side wall of the liquid storage groove 13, another portion of the isolation wall 17 extends into the liquid storage groove 13 to form a ring stop portion 171, and the opening 18 is in communication with the liquid storage groove 13 and the isolation groove 16.

In other implementations, the air inlet column 14 may further be completely embedded in the side wall of the liquid storage groove 13. The isolation wall 17 surrounds the air inlet column 14. A side of the isolation wall 17 that faces the liquid storage groove 13 includes the opening 18 for guiding the liquid in the isolation groove 16 into the liquid storage groove 13.

Referring to FIG. 6, at least one air inlet 131 is provided in the side wall of the liquid storage groove 13, and at least one air inlet 131 is provided at a position at which the air inlet column 14 is embedded in the side wall of the liquid storage groove 13. As a result, when flowing into the liquid storage groove 13 through the air inlet 131, the external air may directly pass through the air inlet column 14, so that the air hole 140 may detect the air flow condition more directly and efficiently.

For example, when an air inlet 131 is provided in the side wall of the liquid storage groove 13, the air inlet 131 is provided at a position at which the air inlet column 14 is embedded in the side wall of the liquid storage groove 13. When two air inlets 131 are provided in the side wall of the liquid storage groove 13, one of the air inlets 131 is provided at a position at which the air inlet column 14 is embedded in the side wall of the liquid storage groove 13, and the other may be symmetrical to the first air inlet 131, or may be provided at another position on the side wall of the liquid storage groove 13, which is not limited herein.

Specifically, when a suction operation is performed on the vaporizer 200, the external air enters the electronic vaporization device 300 through the air inlet 131, and then flows into the vaporizer 200 through the liquid storage groove 13. Therefore, by providing the air inlet 131 at a position at which the air inlet column 14 is embedded in the side wall of the liquid storage groove 13, the external air first passes through the air hole 140, and then flows into the liquid storage groove 13 and the vaporizer 200. If the air inlet holes 140 are provided at other positions on the side wall of the liquid storage groove 13, the external air passes through the liquid storage groove 13 first, carries more moisture, flows through the air hole 140, deposits in a region surrounding the air hole 140, and blocks the air hole 140. As a result, the airflow sensor 20 fails to detect an airflow change, and the electronic vaporization device 300 fails to be normally started.

Further, at least one air suction hole 51 is provided in the shell 50, and the air suction hole 51 is configured to transmit the external air into the electronic vaporization device 300. It can be understood that the at least one air suction hole 51 is provided in a one-to-one correspondence with the at least one air inlet 131, so that the suction resistance of the electronic vaporization device 300 can be reduced.

In this implementation, the first end surface 141 of the air inlet column 14 is higher than the second end surface 172 of the isolation wall 17, where the second end surface 172 is an end surface of the isolation wall 17 that is away from the bottom wall of the liquid storage groove 13, so that the liquid in the isolation groove 16 can be prevented from overflowing into the air hole 140.

In addition, when the user performs a suction action, the isolation wall 17 may block the air from flowing from a region of the liquid storage groove 13 to the air hole 140. Then, at least part of moisture carried by the air flow can be removed, and it is also conducive to the condensation of the moisture on the isolation wall 17 to effectively reduce the moisture carried by the air flow flowing to the air inlet column 14, so that condensation of the moisture on the first end surface 141 can be reduced, which helps reduce the risk of blocking the air hole 140 by the liquid.

Further, a height difference between the first end surface 141 and the second end surface 172 is within a range of 0.2 mm to 0.4 mm. Within the range, the isolation wall 17 can effectively block the moisture from flowing to the air inlet column 14.

For example, the height difference between the first end surface 141 and the second end surface 172 may be 0.2 mm, 0.3 mm or 0.4 mm.

In this implementation, the first end surface 141 is lower than the third end surface 133 of the side wall of the liquid storage groove 13, where the third end surface 133 is the end surface of the side wall of the liquid storage groove 13 that is away from the bottom wall of the liquid storage groove 13, and the third end surface 133 may be configured to abut against the vaporizer 200.

It can be understood that the first end surface 141 is lower than the third end surface 133, and the first end surface 141 is higher than the second end surface 172. That is, when the vaporizer 200 is connected to the power supply assembly 100, an end of the vaporizer 200 that is close to the holder 10 abuts against the third end surface 133, so that interference between the air inlet column 14 and an abutting surface of the vaporizer 200 may be avoided, and further, the air flow condition can be detected by using a gap between the first end surface 141 and the abutting surface of the vaporizer 200.

Figure 7:
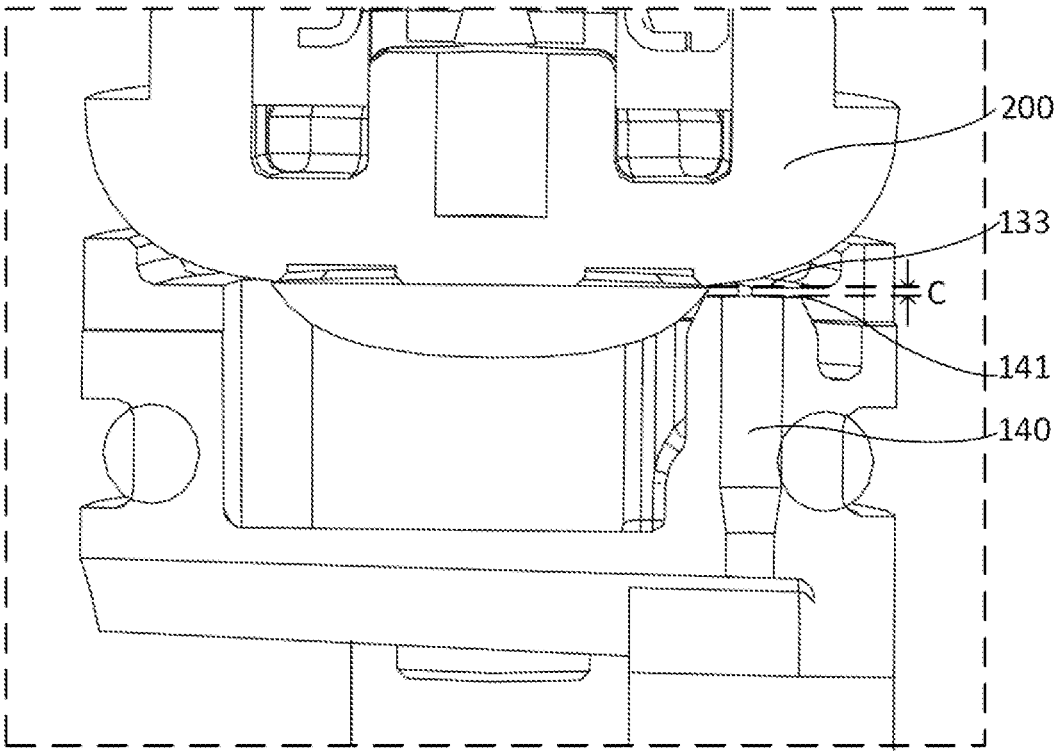
FIG. 7 is cross-sectional view of a partial structure along a line B-B when the holder shown in FIG. 3 is connected to the vaporizer.

Referring to FIG. 7, FIG. 7 is a cross-sectional view of a partial structure along a line B-B when the holder shown in FIG. 3 is connected to the vaporizer. A height difference between the third end surface 133 and the first end surface 141 is within a range of 0.06 mm to 0.1 mm, so that an air interception distance C of the air hole 140 may be reduced, thereby helping reduce the amount of aerosol condensate formed in the air hole 140.

Specifically, the aerosol of the vaporizer 200 easily overflows into the liquid storage groove 13. If the height difference between the third end surface 133 and the first end surface 141 is relatively large, that is, an air interception distance between the air hole 140 and the abutting surface of the vaporizer 200 is also relatively large, it is relatively easy for the aerosol to flow to the air hole 140 and condense in the air hole 140, causing the air hole 140 to be blocked. That is, within the value range, the air interception distance of the air inlet column 14 may be relatively small. In this way, the air flow condition can be detected; moreover, it can prevent a large amount of aerosol from flowing to the air hole 140, thereby effectively reducing the amount of condensate formed in the air hole 140.

For example, the height difference between the third end surface 133 and the first end surface 141 may be 0.06 mm, 0.07 mm, 0.08 mm, 0.09 mm or 0.1 mm.

According to the holder 10 provided in this application, an air inlet column 14 including a drainage slope 151, and an isolation wall 17 and an isolation groove 16 are provided at an end of the holder 10, so that a moat structure is formed on a peripheral side of the air inlet column 14. The moat structure reduces sources of the liquid flowing to the air inlet column 14 and isolates paths of the liquid entering the air hole 140, thereby significantly reducing the risk of blocking the air hole 140 and ensuring that the electronic vaporization device 300 is normally started.

Further, the second end surface 172 of the isolation wall 17 is arranged lower than the first end surface 141 of the air inlet column 14, and a height difference between the first end surface 141 and the second end surface 172 is within a range of 0.2 mm to 0.4 mm; the first end surface 141 is arranged lower than the third end surface 133 of the side wall of the liquid storage groove 13, and a height difference between the third end surface 133 and the first end surface 141 is within a range of 0.06 mm to 0.1 mm, that is, a distance between the air inlet column 14 and the vaporizer 200 is 0.06 mm to 0.1 mm. When a suction operation is performed on the vaporizer 200, the aerosol can be effectively blocked from entering the region of the air inlet column 14. The airflow sensor 20 detects a flow state of air supplemented from the outside through the air hole 140, so that the amount of condensate formed in the air hole 140 can be significantly reduced.

It can be understood that the inventive idea of the moat structure in this application can also be applied to other fields. Provided that liquid, condensate, or the like can be prevented from blocking a channel in a central region, an arrangement manner provided in this application can be used to achieve the objective.

Different from the situation in the related art, this application further provides an electronic vaporization device. The liquid storage groove and the air inlet column are provided at an end of the holder in the electronic vaporization device. The air hole is provided in the air inlet column, the air hole is in fluid communication with the liquid storage groove, and the drainage structure is arranged at an end of the air inlet column that is away from the bottom wall of the liquid storage groove. The drainage structure surrounds the air hole, and the drainage structure is configured to drain the liquid to the liquid storage groove, which not only helps reduce the accumulation amount of the liquid around the air inlet column, but also helps guide the liquid from an end portion of the air inlet column to the liquid storage groove, thereby effectively reducing the risk of blocking the air hole by the liquid.

The foregoing descriptions are merely embodiments of this application, and the protection scope of this application is not limited thereto. All equivalent structure or process changes made according to the content of this specification and accompanying drawings in this application or by directly or indirectly applying this application in other related technical fields shall fall within the protection scope of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A holder, applied to an electronic vaporization device, comprising:

a liquid storage groove and an air inlet column provided at an end of the holder, an air hole being provided in the air inlet column, the air hole being in fluid communication with the liquid storage groove, wherein the air inlet column is provided with a drainage structure surrounding the air hole, wherein the drainage structure is configured to drain liquid to the liquid storage groove, wherein the drainage structure comprises a drainage slope surrounding the air hole, wherein the drainage slope is disposed at an end of the air inlet column that is away from a bottom wall of the liquid storage groove, wherein an isolation groove is formed between the air inlet column and a side wall of the liquid storage groove, and wherein the isolation groove is disposed so as to circumferentially surround the air inlet column so as to reduce sources of liquid around the air hole.

2. The holder of claim 1, wherein an angle between the drainage slope and an axis of the air hole is greater than or equal to 30 degrees and less than or equal to 60 degrees.

3. The holder of claim 1, wherein the air hole is provided on a first end surface of the air inlet column that is away from a bottom wall of the liquid storage groove, and wherein the first end surface has a width greater than or equal to 0.1 mm and less than or equal to 0.3 mm in a radial direction of the air hole.

4. The holder of claim 1, wherein the isolation groove is in communication with the liquid storage groove.

5. The holder of claim 4, wherein a bottom wall of the isolation groove comprises a guide inclined wall configured to guide the liquid to the liquid storage groove.

6. The holder of claim 4, wherein an isolation wall is further arranged at an end of the holder, the isolation wall at least partially surrounding the air inlet column, the isolation groove being provided between the isolation wall and the air inlet column, wherein an opening is formed on the isolation wall, and wherein the isolation groove is in communication with the liquid storage groove through the opening.

7. The holder of claim 6, wherein the air inlet column is at least partially embedded in the side wall of the liquid storage groove, wherein the isolation wall comprises a ring stop portion, the ring stop portion extending from the side wall of the liquid storage groove to the liquid storage groove, the ring stop portion surrounding the air inlet column, and wherein the opening is formed in the ring stop portion.

8. The holder of claim 7, wherein at least one air inlet is provided in the side wall of the liquid storage groove, and wherein at least one air inlet of the at least one air inlet is provided at a position at which the air inlet column is embedded in the side wall of the liquid storage groove.

9. The holder of claim 6, wherein a first end surface of the air inlet column is higher than a second end surface of the isolation wall, wherein the first end surface comprises an end surface of the air inlet column that is away from a bottom wall of the liquid storage groove, and wherein the second end surface comprises an end surface of the isolation wall that is away from the bottom wall of the liquid storage groove.

10. The holder of claim 9, wherein a height difference between the first end surface and the second end surface is within a range of 0.2 mm to 0.4 mm.

11. The holder of claim 9, wherein the first end surface is lower than a third end surface of the side wall of the liquid storage groove, and wherein the third end surface comprises an end surface of the side wall of the liquid storage groove that is away from the bottom wall of the liquid storage groove.

12. The holder of claim 11, wherein a height difference between the third end surface and the first end surface is within a range of 0.06 mm to 0.1 mm.

13. The holder of claim 1, further comprising:

a back plate; and a connecting base that is arranged at an end of the back plate, wherein the liquid storage groove and the air inlet column are provided at an end of the connecting base that is away from the back plate, a mounting cavity is provided in the back plate, and the air hole is in communication with the mounting cavity.

14. The holder of claim 1, wherein the drainage slope comprises a chamfer or fillet.

15. A power supply assembly, comprising:

an airflow sensor; and the holder of claim 1, wherein the airflow sensor is arranged on the holder and is in fluid communication with the air hole.

16. An electronic vaporization device, comprising:

a vaporizer; and the power supply assembly of claim 15, wherein the power supply assembly is connected to the vaporizer and is configured to supply power to the vaporizer.

17. A holder, applied to an electronic vaporization device, comprising:

a liquid storage groove and an air inlet column provided at an end of the holder, an air hole being provided in the air inlet column, the air hole being in fluid communication with the liquid storage groove, wherein the air inlet column is provided with a drainage structure surrounding the air hole, wherein the drainage structure is configured to drain liquid to the liquid storage groove, wherein an isolation groove is formed between the air inlet column and a side wall of the liquid storage groove, and wherein the isolation groove is disposed so as to circumferentially surround the air inlet column so as to reduce sources of liquid around the air hole.

* * * * *